US007451668B2

(12) United States Patent
Hasegawa et al.

(10) Patent No.: US 7,451,668 B2
(45) Date of Patent: Nov. 18, 2008

(54) STARTER HAVING EXCESSIVE-TORQUE-ABSORBING DEVICE

(75) Inventors: Youichi Hasegawa, Kasugai (JP); Sadayoshi Kajino, Nagoya (JP)

(73) Assignee: Denso Corporation, Kariya (JP)

( * ) Notice: Subject to any disclaimer, the term of this patent is extended or adjusted under 35 U.S.C. 154(b) by 319 days.

(21) Appl. No.: 10/938,634

(22) Filed: Sep. 13, 2004

(65) Prior Publication Data

US 2005/0076727 A1 Apr. 14, 2005

(30) Foreign Application Priority Data

Oct. 8, 2003 (JP) ..... 2003-350086

(51) Int. Cl.
*F02N 15/02* (2006.01)
*F02N 15/04* (2006.01)
*F02N 15/06* (2006.01)

(52) U.S. Cl. ..... 74/7 E; 464/46; 475/149

(58) Field of Classification Search ..... 74/7 E, 74/7 R, 6; 475/323, 326, 317, 319–322, 475/331, 335, 344, 149; 464/45, 46, 47
See application file for complete search history.

(56) References Cited

U.S. PATENT DOCUMENTS 2,642,971 A * 6/1953 Hagenbook ..... 192/56.31
2,679,170 A * 5/1954 Prittie ..... 475/159
2,815,684 A * 12/1957 Roche ..... 477/60
2,863,335 A * 12/1958 Miller ..... 475/265
3,249,187 A * 5/1966 McDowall ..... 192/48.5
3,315,773 A * 4/1967 Aschauer ..... 192/48.2
3,436,986 A * 4/1969 Lawrence ..... 475/131
3,851,532 A * 12/1974 Pfluger et al. ..... 74/7 A
4,474,080 A * 10/1984 Day ..... 475/235
4,635,489 A * 1/1987 Imamura et al. ..... 74/7 E
5,102,378 A * 4/1992 Gobert ..... 475/231
5,263,906 A * 11/1993 Antonov ..... 475/257
6,006,885 A * 12/1999 Borgeaud et al. ..... 192/107 R
6,076,413 A 6/2000 Verot et al.
6,572,479 B1 * 6/2003 Saito et al. ..... 464/46
2004/0123686 A1 7/2004 Kajino et al.

FOREIGN PATENT DOCUMENTS

JP A 61-106974 5/1986
JP U-62-71374 5/1987
JP 63-277859 A 11/1988
JP A 04-159455 6/1992
JP 11-117946 A 4/1999

* cited by examiner

*Primary Examiner*—Richard W Ridley
*Assistant Examiner*—James Pilkington
(74) *Attorney, Agent, or Firm*—Oliff & Berridge, PLC

(57) ABSTRACT

A starter for cranking an internal combustion engine includes an electric motor, a planetary gear speed reduction device for reducing a rotational speed of the electric motor and an excessive-torque-absorbing device. The excessive-torque-absorbing device is composed of plural rotatable disks that form an internal gear of the speed reduction device, plural fixed disks and a disk spring. Both disks are alternately laminated and pressed in the laminated direction by the disk spring. When a rotational torque of the electric motor to be transmitted to a pinion gear of the starter exceeds a predetermined level, slippage occurs between the rotatable disks and the fixed disks, and thereby the excessive torque is absorbed.

10 Claims, 5 Drawing Sheets

STARTER HAVING EXCESSIVE-TORQUE-ABSORBING DEVICE

CROSS-REFERENCE TO RELATED APPLICATION

This application is based upon and claims benefit of priority of Japanese Patent Application No. 2003-350086 filed on Oct. 8, 2003, the content of which is incorporated herein by reference.

BACKGROUND OF THE INVENTION

1. Field of the Invention

The present invention relates to a starter for cranking an internal combustion engine, the starter having a planetary gear speed reduction device that reduces a rotational speed of an electric motor, and more particularly to an excessive-torque-absorbing device used together with the planetary gear speed reduction device.

2. Description of Related Art

Examples of an excessive-torque-absorbing device used in a starter are disclosed in JP-A-63-277859 and JP-A-11-117946. The excessive-torque-absorbing device disclosed therein is composed of a rotatable disk connected to an internal gear, a pair of fixed disks sandwiching the rotatable disk from both sides and a disk spring that presses the fixed disks in the axial direction to thereby generate a frictional force between the rotatable disk and the fixed disks. When an excessive rotational torque is applied to the rotatable disk from a pinion gear abutting a ring gear of an internal combustion engine, the rotatable disk slips relative to the fixed disks, and thereby the internal gear connected to the rotational disk rotates. Thus, the excessive torque is absorbed in the device. In another example shown in U.S. Pat. No. 6,076,413, the rotatable disk itself forms the internal gear, and the rotatable disk is pressed from both sides by a pair of fixed disks in the same manner as in the former examples.

In the conventional device disclosed in those documents, only a single rotabable disk that is sandwiched between a pair of fixed disks is used. Therefore, it is difficult to obtain a high gripping force between the rotatable disk and the fixed disks. On the other hand, a high gripping force is required for transmitting a high rotational torque for cranking a diesel engine, for example. If the rotatable disk is pressed too hard by the fixed disks to obtain a high gripping force, friction surfaces of the disks would be damaged by heat generated by friction, or seizing between disks would occur, because the frictional surfaces are not wide enough.

In particular, in the device disclosed in U.S. Pat. No. 6,076,413, the friction surface of the rotatable disk is located outside of the internal gear teeth. Therefore, the width of the friction surface is limited and the friction area cannot be made wide enough. If the force pressing the rotatable disk from both sides is increased to obtain a high gripping force, the friction surface would be damaged soon. It would be possible to increase the gripping force by increasing a friction coefficient of the friction surface. In this case, however, the high gripping force has to be received by the fixed disks having insufficient friction surface. To avoid damages in the fixed disks, the fixed disks have to be made thick and a structure supporting the fixed disks has to be strengthened. If the fixed disks are made thick, seizing between the disks would be caused more easily when the fixed disks are distorted for some reasons in a manner to reduce the friction area. If the supporting structure is strengthened, it is unavoidable to make the starter bulky.

SUMMARY OF THE INVENTION

The present invention has been made in view of the above-mentioned problems, and an object of the present invention is to provide an improved starter having an excessive-torque-absorbing device that is able to transmit a high torque and surely absorbs a torque exceeding a predetermined level.

A starter for cranking an internal combustion engine includes an electric motor composed of a stator and an armature rotating in the stator. A front housing, a center housing, a yoke of the stator and a rear housing are stacked in this order in the axial direction, and these components are firmly connected to one another with through-bolts. The starter further includes a planetary gear speed reduction device for reducing a rotational speed of the armature and an excessive-torque-absorbing device for transmitting a predetermined torque from the armature to a pinion gear and for absorbing an excessive torque. The planetary gear speed reduction device and the excessive-torque-absorbing device are contained in the center housing.

The excessive-torque-absorbing device is composed of plural rotatable disks, plural fixed disks, a disk spring and a cylindrical casing for containing these components. The cylindrical casing has an axial end wall and an open end having a circular claw. The rotatable disks and the fixed disks are alternately laminated on one another, and the fixed disks are connected to the cylindrical casing not to rotate. The disk spring is laminated on the laminated both disks and pressed toward the axial end wall by bending the circular claw formed at the open end of the cylindrical casing. The rotatable disk is ring-shaped and has a radial inside portion and a radial outside portion. On the radial inside portion, an internal gear constituting the planetary gear speed reduction device is formed, and the radial outside portion serves as a friction plate pressed with the fixed disks. The fixed disk is also ring-shaped.

Since the excessive-torque-absorbing device is composed of plural rotatable disks (for example, three disks) and plural fixed disks (for example, four disks), a rotational torque to be transmitted through the device is shared among the plural disks. Therefore, a higher torque can be transmitted without pressing too hard the disks in the laminated direction, and a rotational torque exceeding a predetermined level is absorbed without fail. Since the internal gear is formed on the radial inside portion of the rotatable disk, the starter as a whole can be made compact. Since the components of the excessive-torque-absorbing device are contained in the cylindrical casing, an assembling process can be simplified.

The radial inside portion of the rotatable disk where the internal gear is formed may be made thicker than the radial outside portion that serves as the friction plate. In this manner, the gear surface of the internal gear can be made wide. Depressions may be made on either the rotatable disks or the fixed disks, or both, to retain lubricant therein. Other objects and features of the present invention will become more readily apparent from a better understanding of the preferred embodiments described below with reference to the following drawings.

DETAILED DESCRIPTION OF THE PREFERRED EMBODIMENTS

Figure 1:
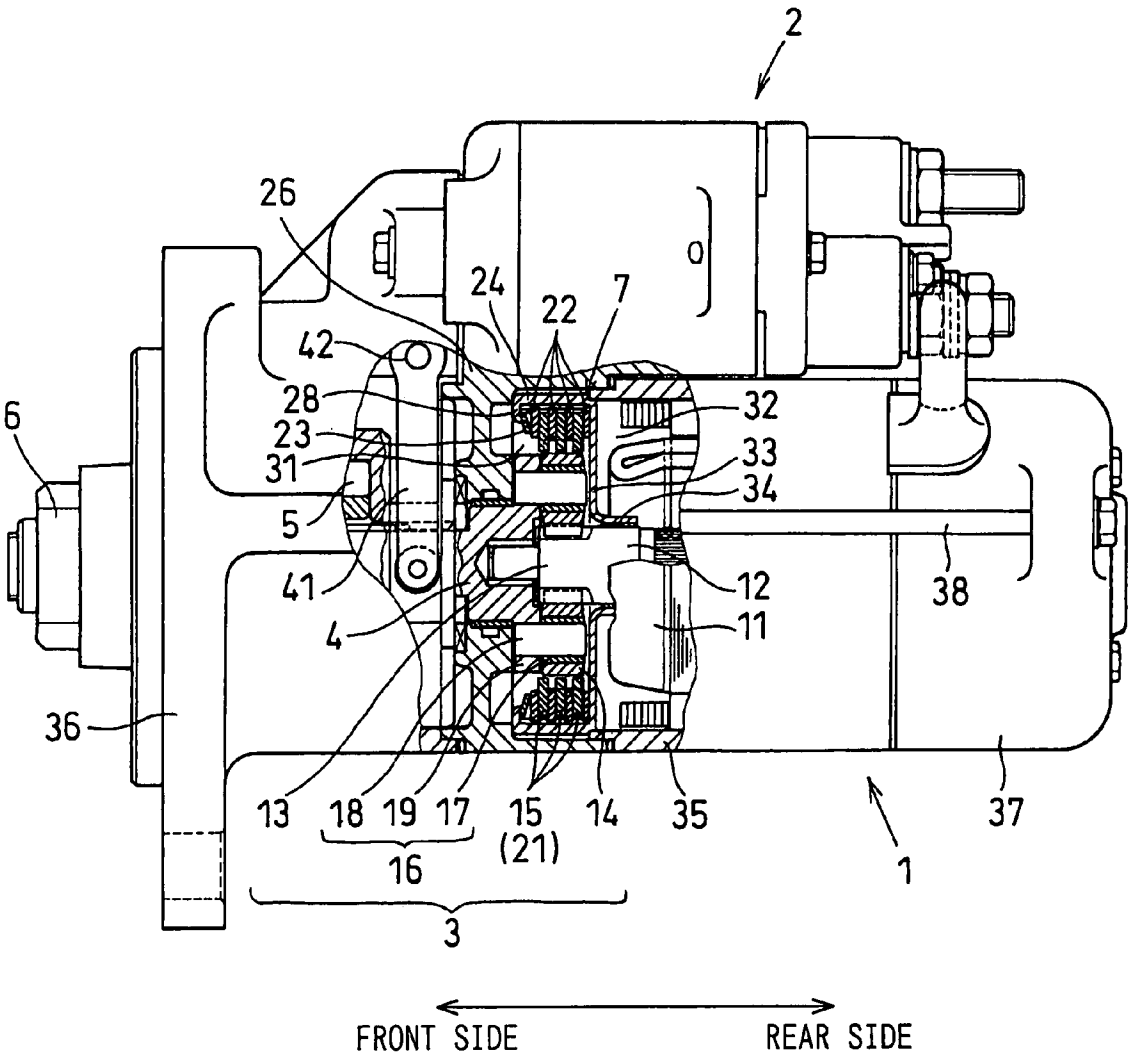
FIG. 1 is a side view, partially cross-sectioned, showing a starter having a planetary gear speed reduction device, as a first embodiment of the present invention.

A first embodiment of the present invention will be described with reference to FIGS. 1-6B. A starter for cranking an internal combustion engine is composed of: an electric motor 1, a magnetic switch 2 for controlling electric power to be supplied to the electric motor 1 in an On-OFF fashion; a planetary gear speed reduction device 3 for reducing a rotational speed of the electric motor 1; an output shaft 4 to which a rotational torque of the electric motor 1 is transmitted after the rotational speed is reduced by the planetary gear speed reduction device 3; a one-way clutch 5 disposed on the output shaft 4; a pinion gear 6 to which a rotational torque of the output shaft 4 is transmitted via the one-way clutch 5; a device 7 for absorbing an excessive torque imposed on the starter; and other associated components.

As shown in FIG. 1, the front side of the starter is covered with a front housing 36, and the rear side of the starter is covered with a rear housing 37. A center housing 26 containing the planetary gear speed reduction device 3 therein and a yoke 35 of the electric motor 1 are disposed between the front housing 36 and the rear housing 37, and these components are firmly connected to one another by through-bolts 38.

The electric motor 1 is a known direct current motor and is composed of a yoke 35 forming a stator and an rotatable armature 11 having an armature shaft 12. Electric power is supplied to the electric motor 1 from an on-board battery by closing a power supply circuit (not shown) in the magnetic switch 2. The armature 11 rotates in the stator when the electric power is supplied. The magnetic switch 2 includes a magnetic coil and a plunger disposed in the magnetic coil. When electric current is supplied to the magnetic coil by closing a key-switch, the plunger in the magnetic coil is driven, and thereby the power supply circuit for supplying power to the electric motor 1 is closed.

Figure 2:
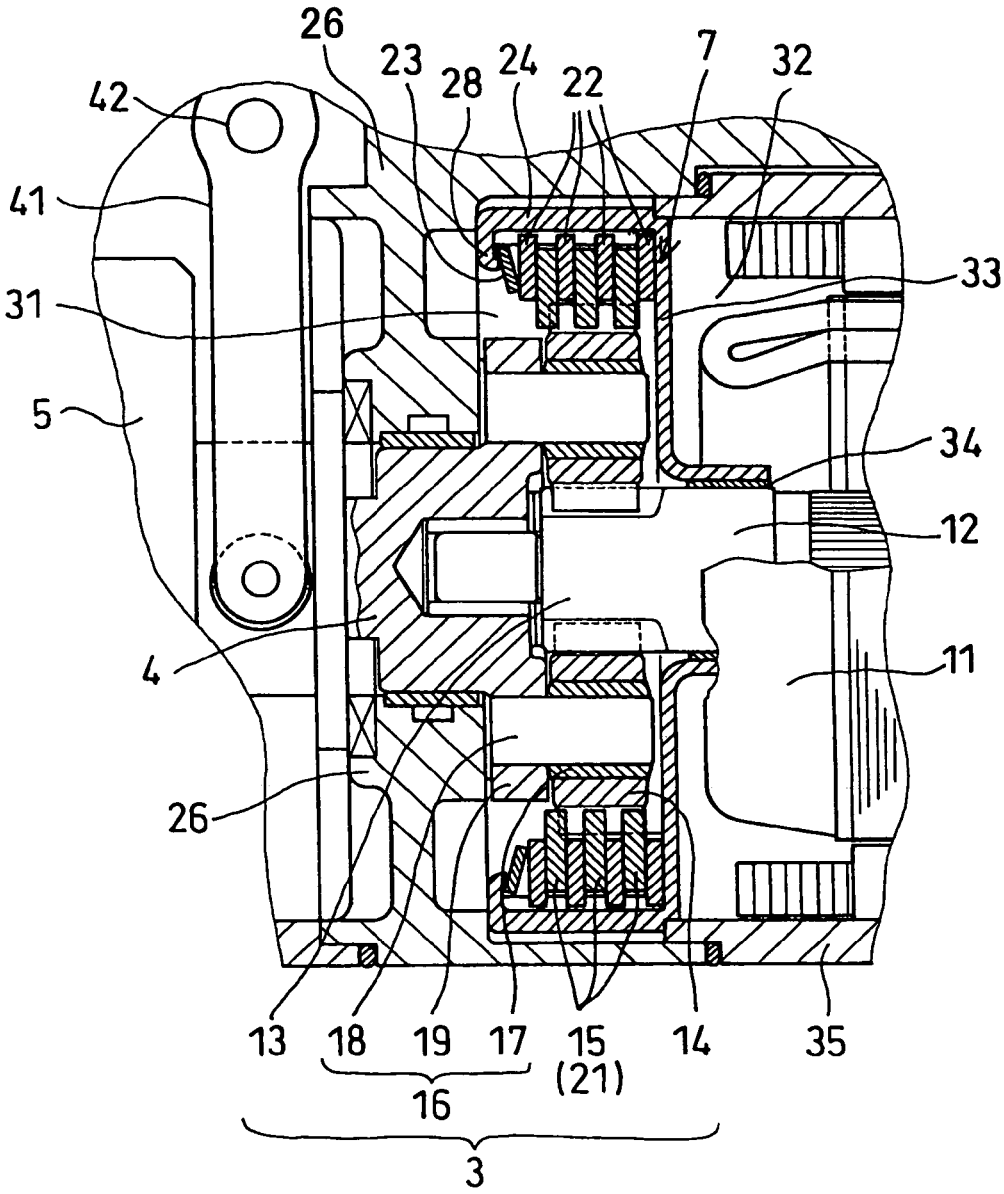
FIG. 2 is a cross-sectional view showing, in an enlarged scale, the planetary gear speed reduction device and an excessive-torque-absorbing device.

As shown in FIG. 2 in an enlarged scale, the planetary gear speed reduction device 3 is composed of a sun gear 13 formed integrally with the armature shaft 12, planetary gears 14 engaging with the sun gear 13, an internal gear 15 engaging with the planetary gears 14, and a planetary gear carrier 16 for rotatably supporting the planetary gears 14 thereon. The planetary gear carrier 16 includes pin holding portion 19 formed integrally with the output shaft 4 as a flange, pins 18 held by the pin holding portion 19 and bearings 17. The planetary gears 14 are rotatably supported by the respective pins 18 via the respective bearings 17. Rotation of the internal gear 15 is restricted by the excessive-torque-absorbing device 7. When the sun gear 13 rotates, the planetary gears 14 orbit around the sun gear 13 while making self-rotation, and the orbital rotation of the planetary gears 14 is transmitted to the output shaft 4 via the planetary gear carrier 16.

The one-way clutch 5 is composed of a clutch outer spline-coupled to the output shaft 4, a clutch inner rotatably supported on the output shaft 4 via a bearing, and rollers disposed between the clutch outer and the clutch inner. The pinion gear 6 is connected to the clutch inner at the front end of the output shaft so that the pinion gear 6 rotates together with the clutch inner. Rotational torque of the armature 11 is transmitted to the pinion gear 6 through the one-way clutch 5, but rotational torque of the pinion is interrupted by the one-way clutch 5 not to be transmitted to the armature 11. The clutch outer includes a cylindrical boss spline-coupled to the output shaft 4, and a lever 41 that is driven to swing around a support pin 42 by the magnetic switch 2 is coupled to an outer groove of the cylindrical boss. When the one-way clutch 5 is driven to the front side by the lever 41, the pinion gear 6 engages with a ring gear of an engine.

Figure 3:
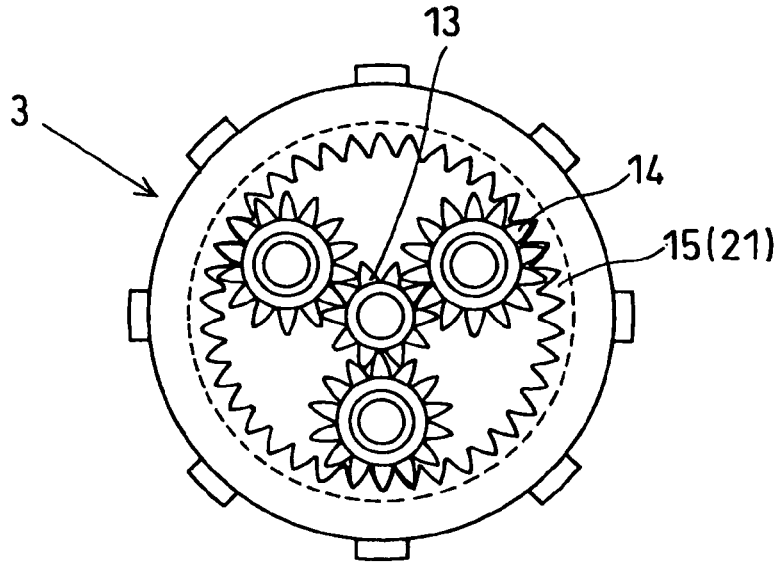
FIG. 3 is a plan view showing a gear structure in the planetary gear speed reduction device.

As shown in FIG. 2, the excessive-torque-absorbing device 7 is composed of a cylindrical casing 24, three rotatable disks 21 which also form the internal gear 15 constituting the planetary gear speed reduction device 3, four fixed disks 22 which are connected to the cylindrical casing 24 and laminated alternately with the rotatable disks 21, and a disk spring 23 that presses the laminated disks in the axial direction. The rotatable disk 21 is a ring-shaped metal plate. Teeth of the internal gear 15 are formed on the radial inside portion of the rotatable disk 21, and the radial outside portion serves as a friction plate, as shown in FIG. 3. In this embodiment, the friction plate constituting the excessive-torque-absorbing device 7 and the internal gear 15 constituting the planetary gear speed reduction device 3 are formed on the common rotatable disk 21. It is possible, however, to form the internal gear 15 and the friction plate by respectively separate members and to mechanically connect both members.

As shown in FIG. 2, the laminated rotatable disks 21 and fixed disks 22 are contained in the cylindrical casing 24 and pressed by the disk spring 23 toward an axial end wall of the cylindrical casing 24, so that the rotatable disks 21 are held between the fixed disks by the friction force therebetween. The axial end wall of the cylindrical casing 24 also serves as a separating wall 33 that separates a reduction device chamber 31 from a motor chamber 32 (refer to FIG. 1). The separating wall 33 includes a boss portion that holds a bearing 34 rotatably supporting the armature shaft 12. The rotatable disks 21 are disposed in the cylindrical casing 24 so that the internal gear 15 and the boss portion of the separating wall 33 are coaxially positioned to each other with a high precision. In this manner, the internal gear 15 correctly engages with the planetary gears 14.

In this embodiment, the internal gear 15 is formed by three rotatable disks 21, not by a single body made by sintering or the like. The rotatable disks 21 can be easily made by stamping a metal plate. Since the internal gear 15 is formed by three rotatable disks 21, there is a small zigzag among the disks 21. This small zigzag reduces a backlash in engagement of the internal gear 15 and the planetary gears 14. As a result, driving noises in the gears are alleviated. Since the internal gear 15 and the friction plate of the excessive torque absorbing device 7 are formed by a common single plate (i.e., the rotatable disk 21), the manufacturing cost can be considerably reduced.

Figure 4:
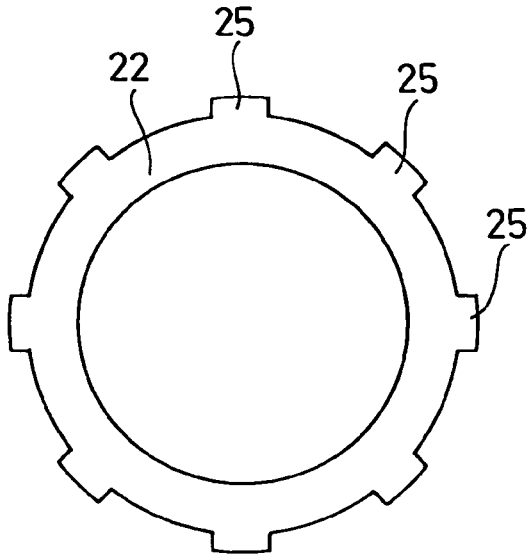
FIG. 4 is a plan view showing a fixed disk used in the excessive-torque-absorbing device.
Figure 5:
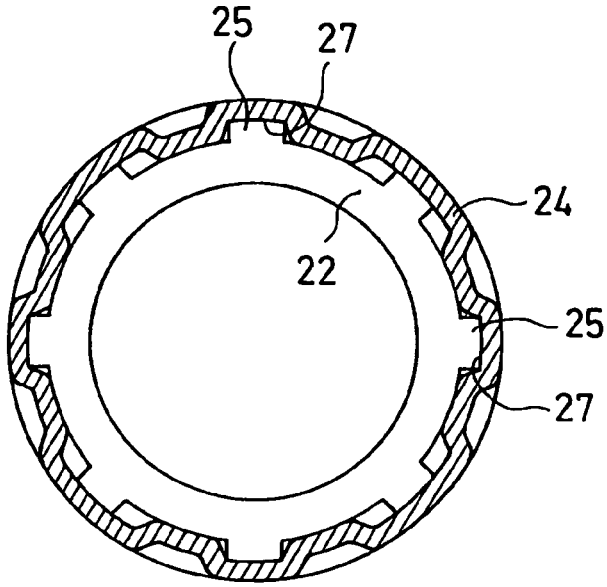
FIG. 5 is a cross-sectional view showing a cylindrical casing in which the fixed disk is held.

As shown in FIG. 4, the fixed disk 22 is formed in a ring-shape having projections 25 on its outer periphery. The inner diameter of the fixed disk 22 is made smaller than the inner diameter of the internal gear 15 so that the fixed disk 22 does not interfere with the planetary gears 14. The cylindrical casing 24 has grooves 27 extending in the axial direction. As shown in FIG. 5, the projections 25 of the fixed disk 22 engage with the grooves 27. In this manner, the fixed disks 22 are held not to rotate in the cylindrical casing 24. Since transmission of rotational torque between the fixed disks 22 and the rotatable disks 21 is allocated to six friction surfaces, thickness of each fixed disk 22 can be made thin. Also, rotational torque applied to the grooves 27 of the cylindrical housing is divided into the number of fixed disks 22 (four disks in this embodiment). Accordingly, the cylindrical casing 24 can be made relatively thin.

The disk spring 23 presses the laminated rotatable disks 21 and the fixed disks 22 in the axial direction against the axial end wall (the separating wall 33). Accordingly, the rotatable disks 21 are held between the fixed disks 22 with the friction force given by the disk spring 23. If the rotational torque applied to the rotational disks 21 exceeds the friction torque, the rotatable disks 21 rotate relative to the fixed disks 22 to thereby absorb or release the excessively high rotational torque. In other words, the rotational torque is transmitted from the armature shaft 12 to the output shaft 4 until the rotational torque exceeds the friction torque between the rotatable disks 21 and the fixed disks 22. When the rotational torque exceeds the friction torque, slippage occurs between the rotatable disks 21 and the fixed disks 22, thereby interrupting transmission of the torque.

In assembling the excessive-torque-absorbing device 7, the laminated disks (three rotatable disks 21 and four fixed disks 22) and the disk spring 23 are first contained in the cylindrical casing 24. Then, a circular claw 28 (refer to FIG. 2) formed at the front open end of the cylindrical casing 24 is bent to press the disk spring 23 toward the axial end wall 33. By adjusting a bending amount of the claw 28, the friction force in the excessive-torque-absorbing device 7 or the maximum torque to be transmitted can be determined. The disk spring 23 is pressed by bending the claw 28 without using any other components in this embodiment. Therefore, the structure of the excessive-torque-absorbing device 7 is simplified. However, it is possible to use other parts such as screws or the like to press the disk spring 23.

As shown in FIG. 1, the reduction device chamber 31 and the motor chamber 32 are separated from each other by the separating wall 33. The axial end wall of the cylindrical casing 24 serves as the separating wall 33. Brush dusts generated in the motor chamber 32 are prevented from entering into the reduction device chamber 31 by the separating wall 33. Accordingly, the gears of the planetary gear speed reduction device 7 and bearings in the reduction device chamber 31 are prevented from being damaged by abrasion with the brush dusts. Since the armature shaft 12 is supported by the bearing 34 held in the boss portion of the cylindrical casing 24, and since the both portion and the rotatable disks 21 are coaxially positioned with high precision, the sun gear 13 and the internal gear 15 are positioned with a correct coaxial relation. Therefore, the planetary gear reduction device 7 is smoothly driven without generating noises. The cylindrical casing 24 including the separating wall 33 is made of a magnetic material such as a steel plate. Therefore, the cylindrical casing 24 is also utilized as a magnetic passage in the stator of the electric motor 1. This contributes to reduction in size and axial length of the electric motor 1.

The center housing 26 containing the cylindrical casing 24 therein is sandwiched between the front housing 36 and the yoke 35 of the electric motor 1, and the front housing 36 and the rear housing 37 are firmly connected in the axial direction by through-bolts 38. Further, the yoke 35 and the center housing 26 are connected to secure the coaxial relation therebetween.

Figure 6A:
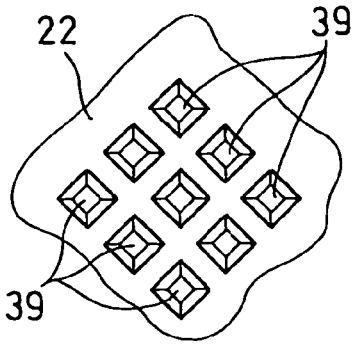
FIG. 6A is a plan view showing depressions formed on a surface of the fixed disk.
Figure 6B:
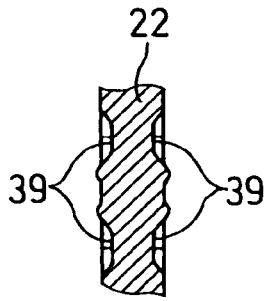
FIG. 6B is a cross-sectional view showing the depressions formed on surfaces of the fixed disk.

As shown in FIGS. 6A and 6B, plural depressions 39 are formed on the surface of the fixed disk 22, and lubricant is retained in the depressions 39. The surfaces of the rotatable disks 21 and the fixed disks 22 serving as the friction surfaces are lubricated by the lubricant. Burn-in or seizing of the friction surfaces are prevented by the lubricant. Thus, the excessive-torque-absorbing device can be used for a long time. The depressions 39 formed on the surface of the fixed disk 22 may be replaced with grooves or the like. The depressions or the grooves may be made on the surface of the rotatable disk 21, or the surfaces of both the fixed disk 22 and the rotatable disk 21. The internal gear 15 is coated with lubricant such as grease, and thereby the planetary gears 14 and the sun gear 13 are lubricated by the lubricant.

Now, operation of the starter described above will be explained. Upon turning on the key-switch of a vehicle, the magnetic coil in the magnetic switch 2 is energized, and thereby the plunger is driven to operate the lever 41. The one-way clutch 5 coupled with the output shaft 4 by means of a helical spline is pushed forward, while rotating, by the lever 41 to thereby shift the pinion gear 6 toward the ring gear of the engine. On the other hand, according to the movement of the plunger, the circuit for supplying power to the electric motor 1 is closed to rotate the armature 11. The rotational speed of the armature 11 is reduced by the planetary gear speed reduction device 3 and is transmitted to the output shaft 4. Rotational torque of the output shaft 4 is transmitted to the pinion gear 6 via the one-way clutch 5. The rotational torque of the pinion gear 6 engaging with the ring gear of the engine is transmitted to the engine. Thus, the engine is cranked up.

After the engine is cranked up, the rotational torque of the engine is transmitted to the pinion gear 6. When the rotational speed of the pinion gear 6 exceeds the rotational speed of the output shaft 4, the one-way clutch 5 interrupts torque transmission from the pinion gear 6 to the output shaft 4. Thus, the armature 11 is prevented from being driven by the engine. Upon turning off the key-switch, the magnetic coil in the magnetic switch 2 is de-energized, and the plunger in the magnetic switch 2 returns to its original position. The power supply circuit is opened and the lever 41 shifts the pinion gear 6 to its original position together with the one-way clutch 5.

Now, operation of the excessive-torque-absorbing device 7 will be described. If the pinion gear 6 abuts the ring gear at a high speed in the course of engagement, a high impact force is generated between the pinion gear 6 and the ring gear. When the rotational torque due to the engagement impact exceeds the maximum torque to be transmitted through the excessive-torque-absorbing device 7, slippage between the rotatable disks 21 and the fixed disks 22 occurs. In other words, the excessive rotational torque exceeding the maximum torque to be transmitted is absorbed by the excessive-torque-absorbing device 7 by permitting rotation of the rotatable disks 21 relative to the fixed disks 22. This torque absorption continues until the rotational torque due to the engagement impact becomes lower than the maximum torque to be transmitted. Thus, the planetary gear speed reduction device 3 and the ring gear 6 are prevented from being damaged by the high impact generated when the pinion gear 6 abuts the ring gear at a high speed.

Since the plural rotatable disks 21 and the plural fixed disks 22 are laminated in the embodiment described above, the number of friction surfaces is increased. Six friction surfaces are provided in the above embodiment, while only two friction surfaces are available in the conventional device using a single rotatable disk. The transmittable maximum torque T is expressed: T=[force pressing the laminated disks]×[radius of friction center]×[friction coefficient]×[number of friction surfaces]. In other words, the transmittable maximum torque is proportional to the number of friction surfaces. More particularly, the maximum transmittable torque in the embodiment of the present invention is 12 kgf·m, while that of the conventional device having one rotatable disk is 4 kgf·m. Therefore, the starter according to the present invention is able to crank a heavy diesel engine while preventing the starter from being damaged by the high engagement impact.

Figure 7:
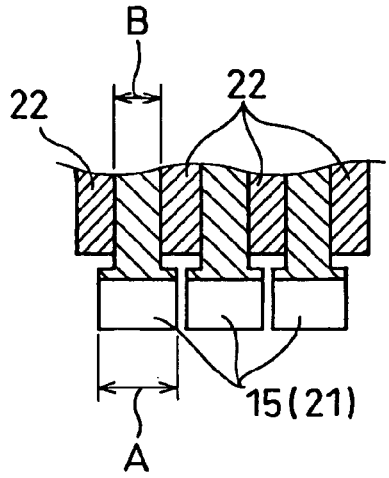
FIG. 7 is a cross-sectional view showing a rotatable disk having an internal gear tooth which is wider than the thickness of the rotatable disk, as a second embodiment of the present invention.

A second embodiment of the present invention will be described with reference to FIG. 7. In this embodiment, the thickness of the rotatable disk 21 is different from that of the first embodiment. Other structures and functions are the same as those of the first embodiment. As shown in FIG. 7, the radial inside portion of the rotatable disk 21 where the internal gear 15 is formed is made thicker than the radial outside portion that serves as the friction surface. That is, the thickness "A" of internal gear tooth is thicker than the thickness "B" of the radial outside portion. In this manner, the total width of the internal gear 15 can be made large. By increasing the width of the internal gear 15, a pressure imposed on the tooth surface (a tooth surface pressure) can be reduced, and thereby abrasion wear of the internal gear 15 can be reduced. Though the thickness difference between A and B is made symmetrically with respect to the thickness center of the rotatable disk 21 in the embodiment shown in FIG. 7, it is, of course, possible to make the thickness difference asymmetrically with respect to the thickness center.

Figure 8:
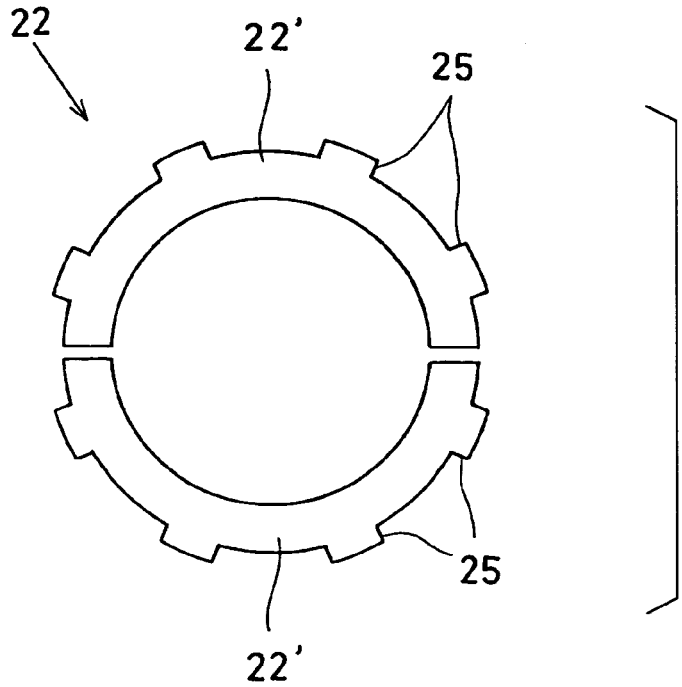
FIG. 8 is a plan view showing a modified form of the fixed disk which is separated into two parts.

The present invention is not limited to the embodiments described above, but it may be variously modified. For example, though three rotatable disks 21 and four fixed disks 22 are used in the foregoing embodiments, such numbers may be reversed. Further, the number of both disks are not limited to those numbers, three or four. The fixed disks 22 may be directly connected to the center housing 26, without using the cylindrical casing 24. In this case, the disk spring 23 and the laminated disks are first installed in the center housing 26, and then the separating wall 33 may be fixed to the center housing 26 with screws or the like, giving a pressure to the laminated disks and the disk spring in the axial direction. By eliminating the cylindrical casing 24, the diameter of the laminated disks can be enlarged to obtain a higher transmittable maximum torque. The fixed disk 22 may be separated into two portions as shown in FIG. 8. In this manner, an amount of the metal plate from which the fixed disks are stamped out can be saved.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A starter for cranking an internal combustion engine, the starter comprising:

an electric motor including an armature connected to the armature shaft;

a planetary gear speed reduction device composed of: a sun gear integrally formed with the armature shaft; a plurality of planetary gears, each having a same number of teeth, engaging with the sun gear and orbiting around the sun gear; an internal gear engaging with the planetary gears; and a planetary gear carrier rotatably supporting the planetary gears thereon, wherein a rotational speed of the armature is reduced and a rotational torque of the armature is transmitted to the planetary gear carrier by restricting rotation of the internal gear;

an output shaft rotating together with the planetary gear carrier;

a pinion gear, to which a rotational torque of the output shaft is transmitted, for cranking the internal combustion engine; and an excessive-torque-absorbing device including: a plurality of rotatable disks that form the internal gear, each rotatable disk having a same number of teeth engaging with teeth of the planetary gears; a plurality of fixed disks laminated alternately with the rotatable disks; and a resilient member for pressing the laminated rotatable disks and the fixed disks in the axial direction, wherein the rotational torque of the armature is absorbed, by causing slippage between the rotatable disks and the fixed disks only when the rotational torque of the armature exceeds a predetermined level, wherein:

gear teeth of the internal gear are formed on the rotatable disks;

the excessive-torque-absorbing device further includes a cylindrical casing having inner grooves extending in the axial direction and forming projections on an outer periphery of the cylindrical casing;

each fixed disk includes projections formed on an outer periphery thereof; and the projections of the fixed disks are engaged with the inner grooves of the cylindrical casing, so that the fixed disks are movable in the axial direction and not rotatable in the cylindrical casing.

2. The starter as in claim 1, further comprising a front housing, a center housing containing the planetary gear speed reduction device and the excessive-torque-absorbing device therein, a yoke forming a stator of the electric motor, and a rear housing, wherein:

the front housing, the center housing, the yoke and the rear housing are stacked in this order in the axial direction and firmly fastened by through-bolts, and the cylindrical casing is fixedly fastened in the axial direction between the center housing and the yoke.

3. The starter as in claim 1, wherein:

depressions for retaining lubricant therein are formed on friction surfaces on the rotatable disks.

4. The starter as in claim 1, wherein:

the rotatable disk is formed in a ring-shape having a radial inside portion and a radial outside portion; and the gear teeth of the internal gear are formed on the radial inside portion, and the radial outside portion serves as a friction plate contacting the fixed disk.

5. The starter as in claim 4, wherein:

the inside portion of the rotatable disk where the gear teeth of the internal gear are formed is made thicker than the outside portion that serves as the friction plate.

6. The starter as in claim 1, wherein:

the cylindrical casing includes an axial end wall and a circular claw formed at an open axial end opposite to the axial end wall; and the laminated rotatable disks and the fixed disks are pressed toward the axial end wall by bending the circular claw.

7. The starter as in claim 6, wherein:

the axial end wall serves as a separating wall separating a chamber containing the planetary gear speed reduction device from another chamber containing the electric motor; and a bearing rotatably supporting the armature shaft is held in the center of the separating wall.

8. The starter as in claim 7, wherein:

the cylindrical casing including the separating wall is made of a magnetic material.

9. The starter as in claim 6, wherein the axial end wall and the circular claw are formed integrally to the cylindrical casing.

10. The starter as in claim 6, wherein a bending amount of the circular claw determines an amount of a friction force in the excessive-torque-absorbing device.

* * * * *